US011346128B2

(12) United States Patent
Ellefred et al.

(10) Patent No.: US 11,346,128 B2
(45) Date of Patent: May 31, 2022

(54) MAGNETIC DOOR-OPERATING ASSEMBLY WITH STATUS INDICATOR

(71) Applicants: Joerg Ellefred, Rheda-Wiedenbrueck (DE); Felix Kaupmann, Rheda-Wiedenbrueck (DE)

(72) Inventors: Joerg Ellefred, Rheda-Wiedenbrueck (DE); Felix Kaupmann, Rheda-Wiedenbrueck (DE)

(73) Assignee: SIMONSWERK GMBH, Rheda-Wiedenbrueck (DE)

( * ) Notice: Subject to any disclaimer, the term of this patent is extended or adjusted under 35 U.S.C. 154(b) by 350 days.

(21) Appl. No.: 16/739,394

(22) Filed: Jan. 10, 2020

(65) Prior Publication Data

US 2020/0226890 A1 Jul. 16, 2020

(30) Foreign Application Priority Data

Jan. 11, 2019 (DE) ..... 102019100639.2

(51) Int. Cl.

| | |
|---|---|
| ***E05B 41/00*** | (2006.01) |
| ***E05B 65/00*** | (2006.01) |
| ***E05B 63/00*** | (2006.01) |
| ***G08B 5/32*** | (2006.01) |
| ***E05B 47/00*** | (2006.01) |

(Continued)

(52) U.S. Cl.

CPC ..... *E05B 41/00* (2013.01); *E05B 9/10* (2013.01); *E05B 39/00* (2013.01); *E05B 47/004* (2013.01); *E05B 47/0038* (2013.01); *E05B 63/0052* (2013.01); *E05B 65/0025* (2013.01);

(Continued)

(58) Field of Classification Search

CPC ..... E05B 9/02; E05B 9/08; E05B 9/10; E05B 17/22; E05B 39/00; E05B 41/00; E05B 47/00; E05B 47/0038; E05B 47/004; E05B 63/0052; E05B 63/16; E05B 65/0025; E05B 65/0035; H01F 7/02; G08B 5/32

See application file for complete search history.

(56) References Cited

U.S. PATENT DOCUMENTS 5,485,733 A * 1/1996 Hoffman ..... E05B 65/46 70/276
6,938,445 B2 * 9/2005 Huang ..... E05B 41/00 70/432

(Continued)

FOREIGN PATENT DOCUMENTS

| | | |
|---|---|---|
| DE | 10122518 A | 11/2002 |
| DE | 202004009405 U | 9/2004 |
| EP | 3162988 A | 5/2017 |

*Primary Examiner* — Christopher J Boswell
(74) *Attorney, Agent, or Firm* — Andrew Wilford

(57) ABSTRACT

A door-operating assembly has an operating device having a device housing and a device magnet and rotatable in the housing about a first axis between a first functional position and a second functional position, and a status indicator that is coupled with the operating device and has an indicator housing and an indicator magnet movable in the indicator housing along the first axis between a first display position and a second display position. The magnets are so oriented that rotation of the device magnet about the first axis from the respective first functional position into the respective second functional position displaces the indicator magnet axially of the first axis from the first display position into the second display position.

15 Claims, 15 Drawing Sheets

(51) Int. Cl.
*E05B 9/10* (2006.01)
*E05B 39/00* (2006.01)
*H01F 7/02* (2006.01)

(52) U.S. Cl.
CPC ..... *E05B 65/0035* (2013.01); *G08B 5/32* (2013.01); *H01F 7/02* (2013.01)

(56) References Cited

U.S. PATENT DOCUMENTS

| | | | | |
|---|---|---|---|---|
| 8,641,105 | B2 * | 2/2014 | Goodman | H01F 7/04 292/251.5 |
| 9,879,445 | B2 * | 1/2018 | Gopalakrishnan | E05B 41/00 |
| 10,563,425 | B2 * | 2/2020 | Lunday | E05B 41/00 |
| 2014/0311197 | A1 * | 10/2014 | Abel | E05B 41/00 70/432 |
| 2015/0225982 | A1 * | 8/2015 | Bronner | E05B 63/0017 70/432 |
| 2020/0224470 | A1 * | 7/2020 | Ellefred | E05B 65/0025 |
| 2020/0270900 | A1 * | 8/2020 | Lin | E05B 41/00 |
| 2021/0372161 | A1 * | 12/2021 | Clifford | E05B 41/00 |
| 2022/0010588 | A1 * | 1/2022 | Koenig | E05B 41/00 |

* cited by examiner

MAGNETIC DOOR-OPERATING ASSEMBLY WITH STATUS INDICATOR

FIELD OF THE INVENTION

The present invention relates to a magnetic door-operating assembly. More particularly this invention concerns such an assembly having a status indicator and that is normally mounted on a door.

BACKGROUND OF THE INVENTION

A door-operating assembly typically comprises an operating device on the door and a status indicator coupled therewith. The operating device comprises a first magnet assembly that is rotatable about an axis between a first functional position and a second functional position.

Door-operating assemblies are used to perform certain operating functions on a door panel. These can for example consist of a locking function that is usually implemented by rotating a locking element with a key or a handle. The operating device can be rotated back and forth between an open position and a closed position.

Even in cases where operation is not provided on both sides, it can be of interest to know the current functional state of the operating device on the non-operating side. Such systems are common for locks on interior doors, for example, that secure especially private areas such as bathrooms or bedrooms. An indicator or display element is provided for this purpose to indicate whether the mechanism on the opposite side of the door panel is in an open or closed functional position. The system of this generic type can also be used independently of a locking function, for example to signal an "occupied" status on the other side of the door without the door being locked.

Such transferring of information through the door panel is problematic if the door panel cannot be drilled or can only be pierced with great effort. In the case of all-glass door panels made of safety glass, for example, it is not possible to add holes later. For this purpose, a system is known from DE 20 2004 009 405 in which the closed state of a mechanical lock on one side of the door panel is magnetically transmitted to a display element on the other side of the door panel. The display element there is coupled with rotation of the lock by magnets, so that the current closed state can be recognized from the angular position. An emergency release is also provided there in which the display element can be rotated by a coin in a slot. The lock is rotated by magnetic interaction in order to open it. In order to enable sufficient torque to be generated that a reasonably reliable emergency release is ensured, the magnets must be spaced somewhat far from the rotation axis. Doing this requires that the mechanism be rather large.

Such a system is difficult to integrate into particularly narrow door handles as the housing of the display element.

OBJECTS OF THE INVENTION

It is therefore an object of the present invention to provide an improved an improved door-operating and display assembly.

Another object is the provision of such an improved an improved door-operating and display assembly that overcomes the above-given disadvantages.

SUMMARY OF THE INVENTION

A door-operating assembly has according to the invention an operating device having a device housing and a device magnet and rotatable in the housing about a first axis between a first functional position and a second functional position, and a status indicator that is coupled with the operating device and has an indicator housing and an indicator magnet movable in the indicator housing along the first axis between a first display position and a second display position. The magnets are so oriented that rotation of the device magnet about the first axis from the respective first functional position into the respective second functional position displaces the indicator magnet axially of the first axis from the first display position into the second display position.

Taking the generic door-operating assembly as a point of departure, the status indicator according to the invention comprises a second magnet assembly that can be moved along the rotation axis (axial direction) by magnetic interaction with the first magnet assembly between a first display position and a second display position. Here, the second magnet assembly has a first spacing along the rotation axis in the first display state, which spacing differs from a second axial spacing in the second display state. Since the signal movement is wholly axial, the display element can have a very delicate design in the radial direction relative to the rotation axis. In particular, integration into a door handle is readily possible.

The first magnet unit of the operating device can be rotated particularly by a operating device. This can preferably be a (cylinder) lock or an operating handle. In a preferred variant, the operating handle has a cylindrical operating surface with a surface that is anti-slip at least with respect to rotation, particularly in the form of a rubber coating and/or fluting.

The second magnet assembly is preferably coupled with a display element that is not visible on an outer surface of the status indicator in the first display position and is visible in the second display position. The outer surface is particularly an end face of the display element that runs parallel to the face of the door. Such an arrangement can be integrated with particular ease into a handle. The display element is basically invisible particularly when set back from the outer surface by an amount which is greater than the greatest extension on the plane of the outer surface.

The display element is especially preferably formed by a pin with an end face that is visible on, and normally flush with, the outer surface in the second display position. The pin can be narrow and, in particular, be designed with a round cross section and have a width (diameter) of from 5 to 10 mm.

According to an especially preferred embodiment of the invention, the first magnet assembly comprises a first magnet whose magnetic direction is perpendicular to the rotation axis. The second magnet assembly comprises a second magnet whose magnetic direction is perpendicular to the rotation axis. The first magnet and the second magnet can be bar magnets. Their magnetic directions is a line from the south pole to the north pole of the magnet. In particular, the orientation can also be described by the leading dipole moments of the magnetic field that is generated by the magnet. A magnet is to be assumed to be aligned perpendicular particularly if its alignment with the rotation axis forms an angle of greater than 80°, in particular greater than 85°. The orientation of the magnet does not have to intersect the rotation axis, but can do so in a preferred variant.

In an embodiment with a first magnet having a magnetic direction oriented perpendicular to the rotation axis and a second magnet whose magnetic direction is also oriented perpendicular to the rotation axis, axial magnetic repulsion is produced by an arrangement generally in the same direction (if the first magnetic direction and the second magnetic direction, each projected onto a normal plane of the rotation axis, form an angle between 0° and 90°). On the other hand, with an arrangement where the magnetic directions point generally oppositely (relative alignment at an angle of 90° to 180°), magnetic attraction occurs in the axial direction. This can be used to shift the second magnet assembly between the first display position and the second display position. In addition, there is always a torque acting on both magnets toward the maximally opposite (antiparallel) arrangement.

A further advantage of this design is that the total external magnetic field resulting from the first magnet and the second magnet is strengthened in the case of an arrangement in the same direction (particularly a generally parallel arrangement) and weakened in the case of an arrangement in the opposite direction (particularly an antiparallel arrangement). This effect can be used to actuate a functional unit, particularly a lock.

In a preferred embodiment, the first magnet unit is in contact with a first stop in the first functional position. As a result, the first magnet unit can only be rotated in a first rotational sense from the first functional position. Further rotation counter to the first rotational sense is not possible. Starting from the first functional position, rotation is possible in the first rotational sense to a second stop. In the second functional position, the first magnet unit engages the second stop, so that further rotation in the first rotational sense is no longer possible. Between the first stop and the second stop, there is an angular range of preferably 180° in which the first magnet unit can be freely rotated. As a result of a rotation of 180°, the polarity of a first magnet that is oriented perpendicular to the rotation axis unit can be reversed in the first magnet.

In the first functional position, the second magnet assembly especially preferably exerts a torque on the first magnet assembly that is oriented counter to the first rotational sense. Furthermore, in the second functional position, the second magnet assembly exerts a torque on the first magnet assembly that is oriented in the first rotational sense. This has the effect that the first magnet assembly is held in the respective end positions as a result of the magnetic interaction with the second magnet assembly.

In an especially preferred embodiment, the door-operating assembly is set up to operate a latch. The latch can be moved between a locking position and a release position as a result of the magnetic field of the first magnet assembly and/or of the second magnet assembly. Especially preferably, the latch can be moved into a locking position when an especially strong magnetic field emanates from the first magnet assembly and second magnet assembly and into a release position when no or only a weak magnetic field emanates from the first magnet assembly and second magnet assembly. When the door is opened, the operating device then only creates a weak magnetic far field, which entails fewer risks with respect to magnetic cards or medical products such as pacemakers, for example.

According to an especially preferred embodiment, the second magnet assembly is rotatably held on the status indicator in an axial position of the first display position between a third stop that acts in a second rotational sense and a fourth stop that acts counter to the second rotational sense. The first and second directions of rotation can be in the same direction or identical. The second magnet assembly rotates about a second rotation axis that preferably is parallel to the first rotation axis.

If the second magnet assembly is in the axial position of the first display position, it can be preferably pivoted freely between the third stop and the fourth stop. In the first display position, the magnet assembly rests against the third stop. Preferably, an effective magnetic torque that is created by the first magnet assembly acts toward the third stop. Furthermore, the second magnet assembly preferably cannot be rotated in the second display position. Smaller rotational movements of no more than 5° due to the fitting clearance are irrelevant here. In the second functional position, the first magnet assembly torques the second magnet unit to move counter to the second rotational sense (both in the first display position and in the second display position). Since rotation is blocked in the second display position, the second magnet assembly remains immobile in the second display position.

If the second magnet assembly is moved from the second display position into the first display position by manual interaction (while the first magnet assembly is in the second functional position), the first magnet is free to move in the opposite rotational sense. Due to the acting torque, the second magnet assembly moves counter to the second rotational sense within the angular range that is delimited by the third stop and the fourth stop. The orientation of the first magnet assembly and the second magnet assembly thus move into a configuration in which the first magnet assembly and the second magnet assembly are increasingly oriented in opposite directions, and the external magnetic field is weakened through closure of the field lines.

In the case of design variants with a first and a second bar magnet that are oriented perpendicular to the rotation axis, the second magnet assembly can be preferably oriented such that the two magnets are oriented (almost) antiparallel relative to one another. The overall field is thus reduced. As a result, a correspondingly designed closing element can be released. This enables the possibility of a magnetic emergency release. Direct mechanical interaction with the first magnet assembly is not necessary. It can remain in the second functional position.

The invention also relates to a door with a door panel that can be moved between an open position that clears the door opening at least partially for passage and a closed position that blocks the door opening. Without restricting the invention, the door panel can swing or slide. The plane of the door panel extends in a vertical direction, in a horizontal direction, and in a horizontal thickness direction perpendicular to the plane. The extension of the door panel in the thickness direction is substantially less than in the vertical and horizontal directions (at least by a factor of 10).

It lies within the scope of the invention for the above-described door-operating assembly to be provided on the door. The operating device is mounted on a first face of the door panel, and the status indicator is mounted on a second face of the door panel that is directed opposite the first face in the thickness direction. The door panel thus fills the space between the operating device and the status indicator in the thickness direction. The operating device and status indicator are mounted so as to overlap one another as seen in the thickness direction. In the door according to the invention, the functional state of the operating device (and, where appropriate, an emergency release) can be transmitted through the door panel solely magnetically. A direct connection to the mechanical coupling is not necessary.

Especially preferably, the door panel is continuous and imperforate at least in the area of the operating device and status indicator. Holes or recesses are not necessary in this area, because the coupling is magnetic.

The door according to the invention, which is designed as an all-glass door panel, is very especially suitable for door panels. Glass door panels are not readily modified by drilling or otherwise piercing. It is therefore highly advantageous to provide an uninterrupted all-glass door panel to which the operating device and the status indicator can be glued. In order to additionally avoid unnecessary interruption of the all-glass door panel, the elements for moving between the open position and the closed position, door hinges and rollers, can be clamped to edges of the all-glass door panel.

According to a preferred embodiment, the door has a latch. The latch can be moved by magnetic interaction with the door control arrangement between a locked state in which the door panel is locked in the closed position and a release state in which the door panel is free to slide or swing. Due to the magnetic interaction, the latch can be operated contactlessly and set at a spacing from both the operating device and the status indicator.

According to an especially preferred embodiment, the latch is mounted in a frame surrounding the door opening and forming a door jamb. This enables the add-on parts of the door panel, particularly of the all-glass door panel, to be further reduced. This enables a particularly compact and elegant appearance to be achieved. An unnecessarily large, clunky lock case on the door panel is eliminated.

In order to further improve the visual impression, the operating device and/or the status indicator are set at a spacing from a side edge of the door panel. The respective closest side edge is used as the reference point.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
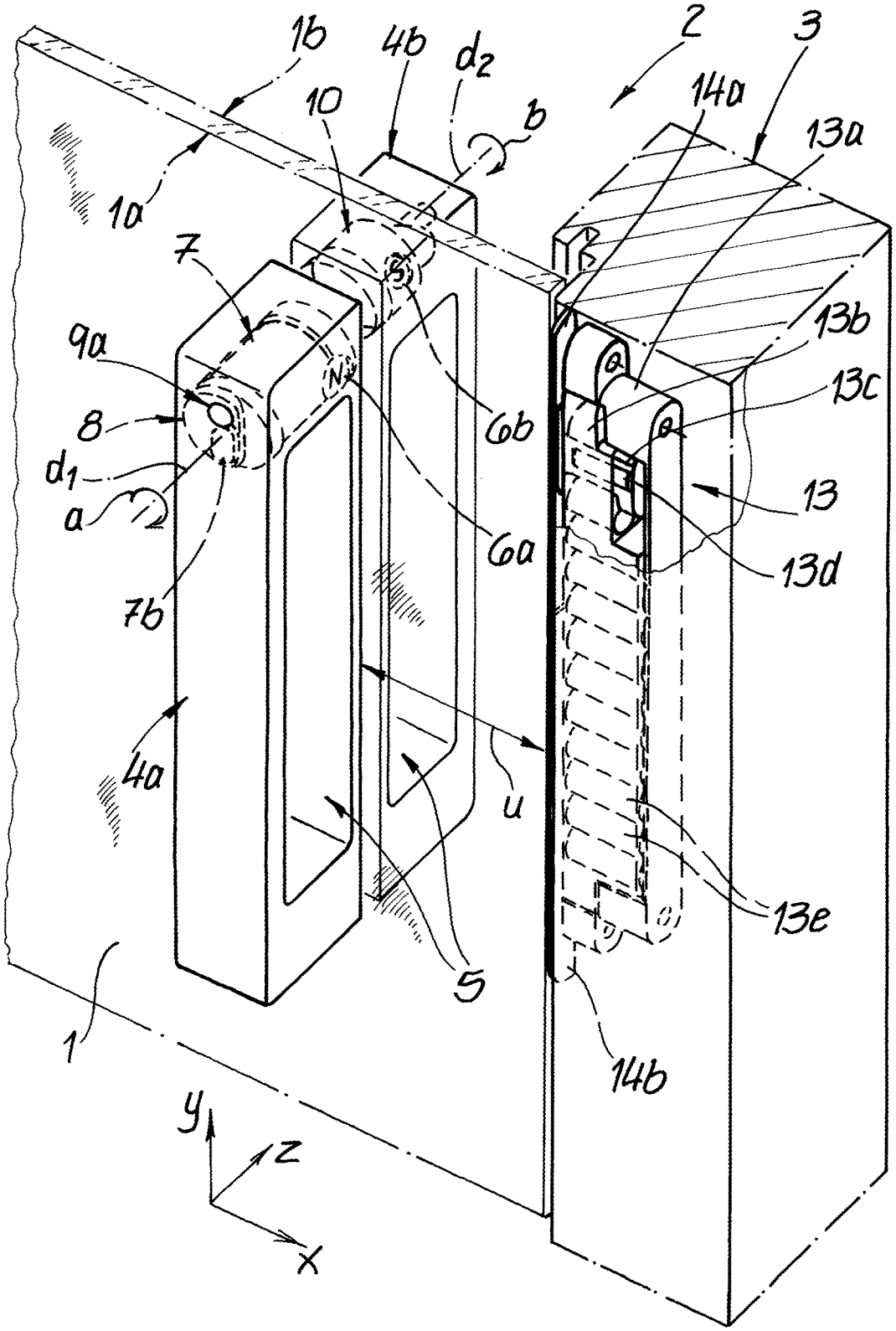
FIG. 1 is a partially exploded view of an inventive door assembly according to a first embodiment.

FIG. 1 shows a door assembly according to the invention with a door panel 1 that can be moved between a closed position (shown here) that blocks the door opening 2 and an open position that frees the door opening 2 at least partially. The door panel extends in a horizontal direction x, a vertical direction y, and a thickness direction z that is also horizontal and perpendicular to the horizontal direction x. The thickness of the door panel 1 in the thickness direction z is smaller than the width in the horizontal direction x or the height in the vertical direction y by a factor of at least 10. A door jamb 3 against which the door panel 1 is received flush in the closed state is to the side of the door panel 1.

According to the invention, a door-operating assembly with an operating device having a housing 4*a* and a status indicator having a housing 4*b* magnetically coupled therewith are provided on the door panel 1. The operating-device housing 4*a* is mounted on a first face 1*a* of the door panel 1. The status-indicator housing 4*b* is fastened to a second face 1*b* that is directed oppositely to the first face 1*a*. Between the operating-device housing 4*a* and the status-indicator housing 4*b*, the door panel 1, which is wholly of glass, has no openings. In a view in the thickness direction z, the operating-device housing 4*a* and the status-indicator housing 4*b* are fastened directly opposite each other on the respective faces 1*a* and 1*b*. The operating-device housing 4*a* and the status-indicator housing 4*b* each have an opening 5 for forming a door handle. Here, the opening 5 is enclosed by the material of the operating-device housing 4*a* and status-indicator housing 4*b*. The attachment to the faces 1*a* and 1*b* of the door panel 1 is achieved with an adhesive.

A first magnet subassembly that is formed by a first magnet 6*a* set in a sleeve 7 is provided in the operating-device housing 4*a* so as to rotate about a first axis $d_1$. In the first functional position shown, the south-to-north magnetic direction of the first magnet 6*a* extends in the horizontal direction x toward the jamb 3 and diametrally perpendicular to the axis $d_1$.

Figure 2A:
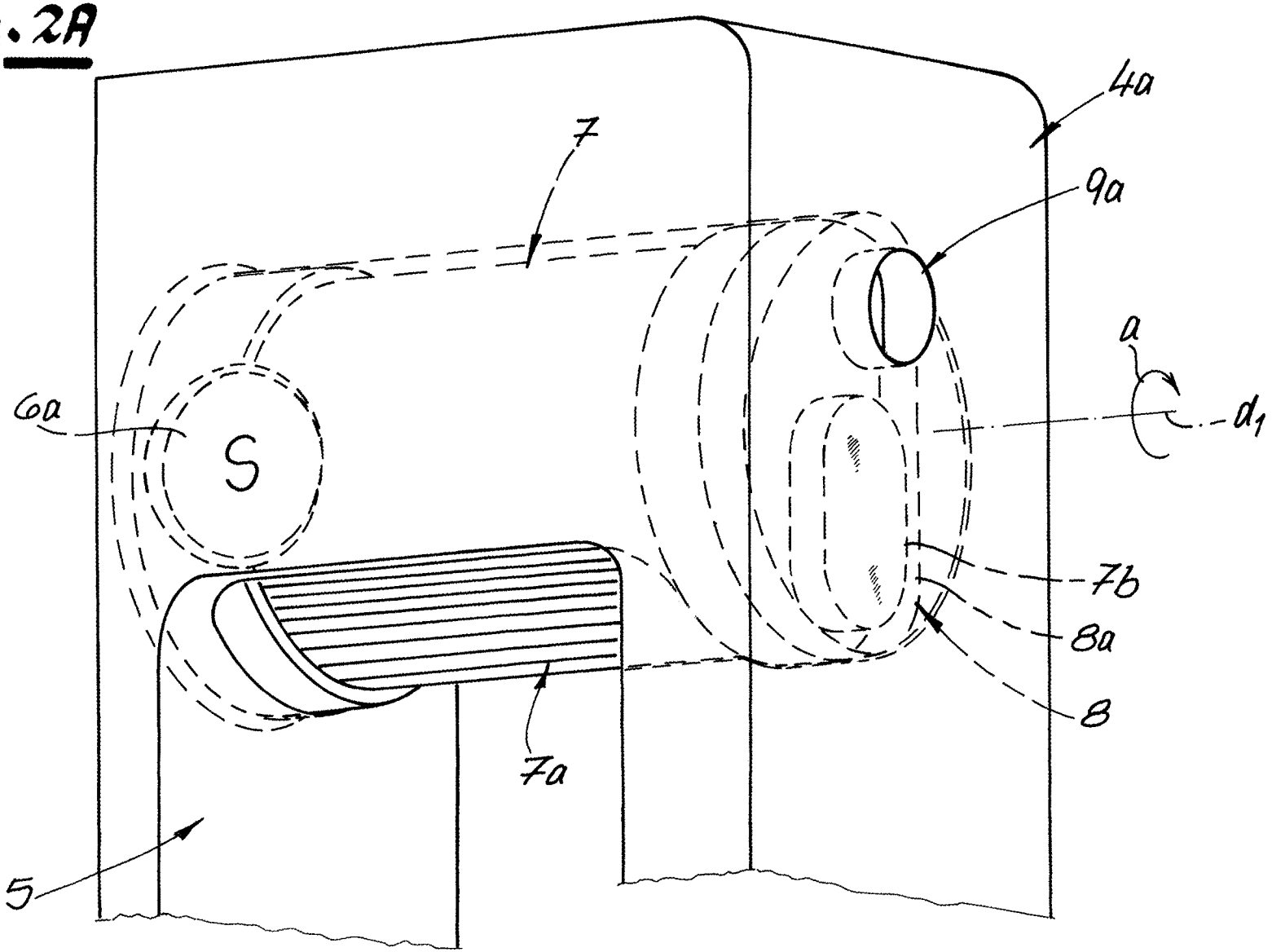
FIG. 2A is a large-scale view of a detail of the operating device in a first functional position.
Figure 2B:
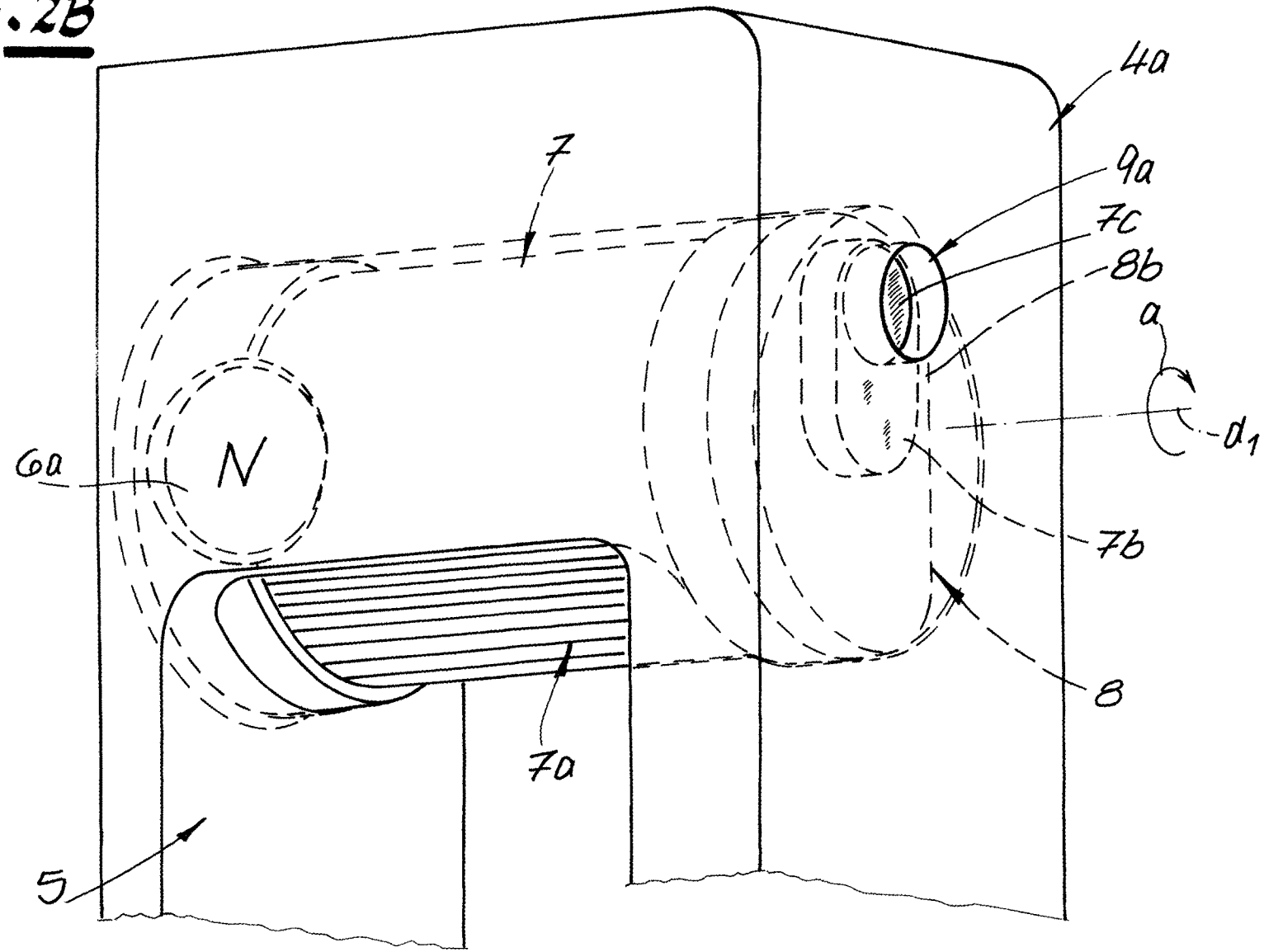
FIG. 2B is a large-scale view of a detail of the operating device in a second functional position.

The upper part of the operating-device housing 4*a* is shown in detail in FIGS. 2A and 2B. FIG. 2A shows the first functional position also shown in FIG. 1. The south pole of the first magnet 6*a* can be seen in the view on the left. The sleeve 7 is mounted such that its mainly cylindrical outer surface 7*a*, which is longitudinally fluted parallel to the rotation axis $d_1$, projects into the opening 5 for manual rotation of the sleeve 7 and magnet 6*a*. A rounded radially extending ridge 7*b* is formed on an outer end face of the sleeve 7 and engages in a generally semicircular and axially inwardly open recess 8 of the housing of the operating-device housing 4*a*. Due to the interaction of the ridge 7*b* with the angularly limited recess 8, rotation of the sleeve 7 about its axis $d_1$ is limited to an angle of 180°.

From the first functional position (opening position) that is shown, the sleeve 7 can only be moved in a first rotation direction a. Rotation counter to the first rotation direction a is prevented by a first stop edge 8*a* of the recess 8. FIG. 2B shows the same view in a second functional position (closed position). The north pole of the first magnet 6*a* is now visible on the left in the view. The ridge 7*b* now abuts a second stop edge 8*b* of the recess 8, so that further rotation in the first rotation direction a (closing direction) about the rotation axis $d_1$ is no longer possible. In the second functional position, a colored axially outwardly directed face 7*c* of the ridge 7*b* is visible through an eccentric and axially open viewing aperture 9*a* of the operating-device housing 4*a*. As a result, the fact that the device 4*a* is in the second functional state (closed state) is signaled from the side of the operating-device housing 4*a* (operating side).

Figure 3A:
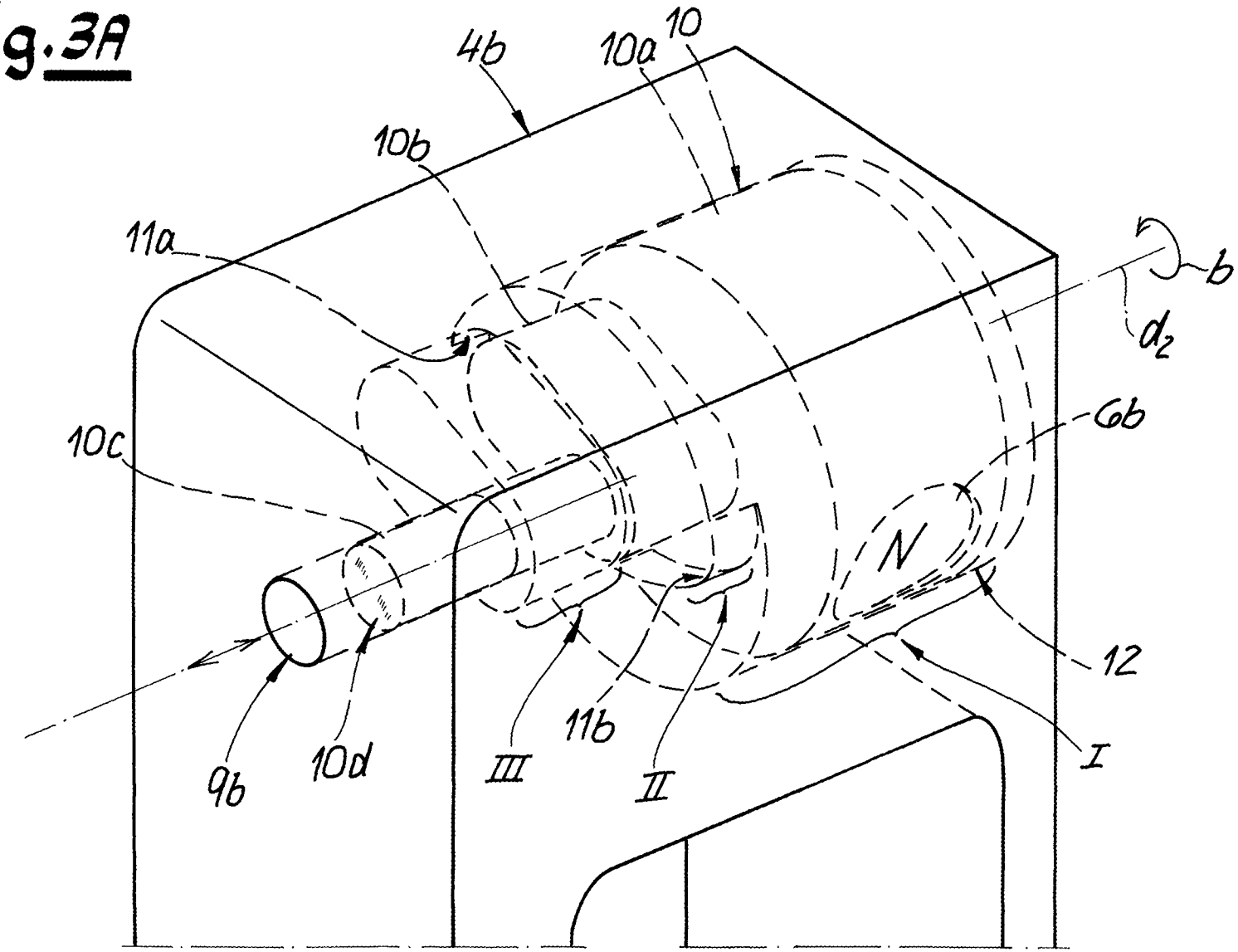
FIG. 3A is a large-scale view of a detail of the status indicator in a first display position.
Figure 3B:
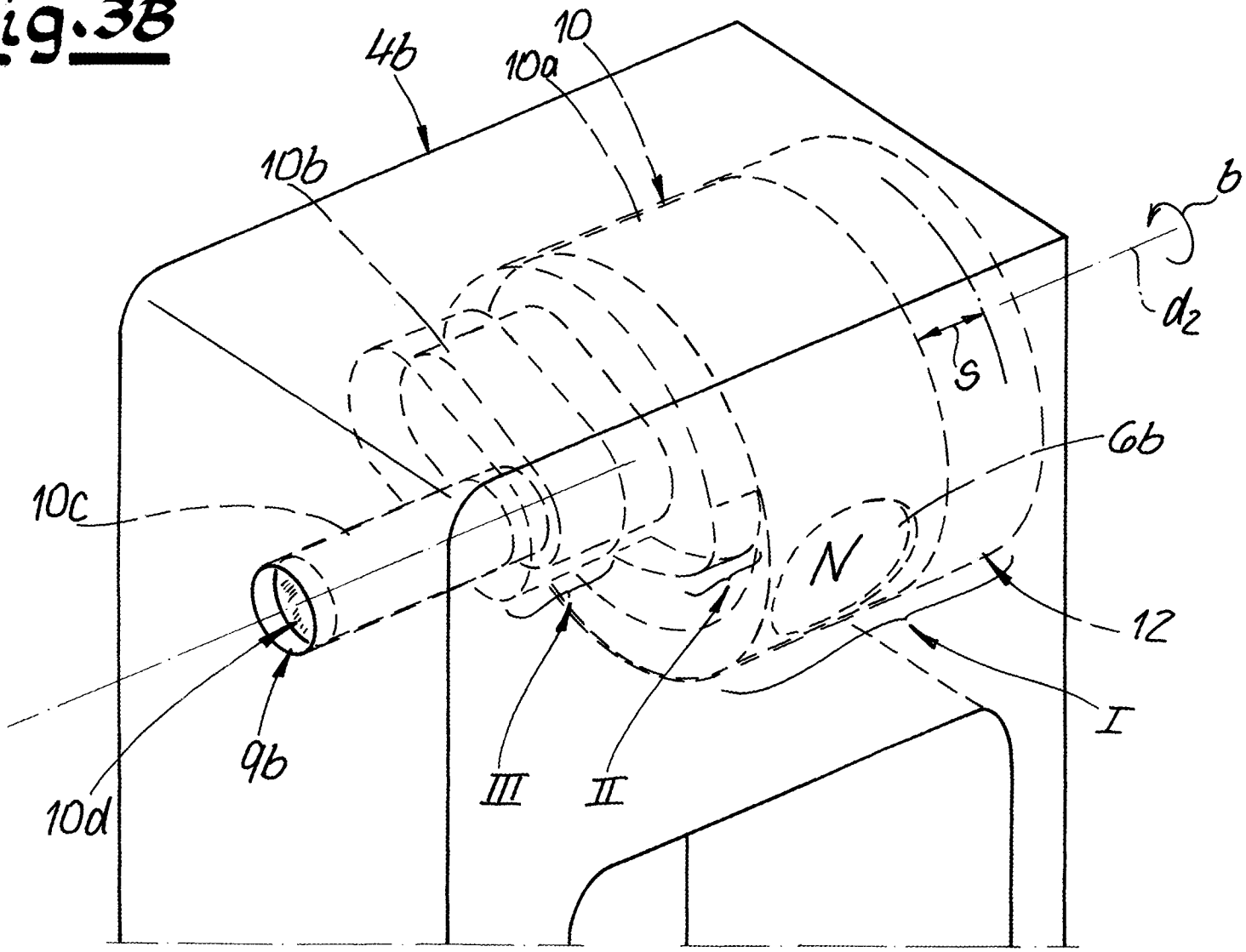
FIG. 3B is a large-scale view of a detail of the status indicator in a second display position.

FIGS. 3A and 3B, on the other hand, show the status-indicator housing 4*b* in a first display position (FIG. 3A) and in a second display position (FIG. 3B). A second magnet subassembly that is formed by a second magnet 6*b* is carried in a second sleeve 10 within the status-indicator housing 4*b*. The sleeve 10 has a cylindrical portion 10*a* in which the bar magnet 6*b* is received in a form-fitting manner, with the magnetic direction of this magnet 6*b* perpendicular to an axis $d_2$ of the portion 10*a*. An eccentric rounded and radially extending ridge 10*b* is provided on an outer end face of the cylindrical portion 10*a*. A pin-shaped extension 10*c* with an end face 10*d* emerges centered on the axis $d_2$ from the ridge 10*b* concentrically with the outer surface of the cylindrical portion 10*a*.

The second sleeve 10 is supported in a stepped recess 12 of the status-indicator housing 4*b*. A first portion I of the recess 12 has a cylindrical inner surface that engages around the cylindrical portion 10*a* of the first sleeve 10 in a form-fitting manner. This portion I is axially somewhat longer than the portion 10*a* of the sleeve 10 to permit limited axial movement between the sleeve 10 and housing 4*b*. Due to the complementary fit of the sleeve 10 and the housing 4*b* at the portion I, the sleeve 10 is rotatable about the second axis $d_2$ that in fact is parallel to the axis $d_1$. The ridge 10*b* projects into a second portion II that is shaped to limit rotation of the second sleeve 10

In the first display position shown in FIG. 3A, the ridge 10*b* abuts against a third stop edge 11*a* of the second portion II, so that further rotation in a second direction b of rotation is no longer possible. The second sleeve 10 can be rotated to a fourth stop edge 11*b* counter to the second direction b of rotation, the relative rotation being less than 180°.

A third portion III ends flush against the third stop 11*a* at the second portion II of the recess 12. When compared to FIG. 3B, it is clear that the second sleeve 10 has been displaced in the axial direction through a spacing s. As a result, the ridge 10*b* of the second sleeve 10 is received in a complementary third portion III, so that rotation about the second axis $d_2$ is possible neither in the second direction b of rotation nor counter to this direction. At the same time, the end face 10*d* is visible in an associated viewing aperture 9*b* of the status-indicator housing 4*b*. The end face 10*d* is colored.

Figure 4A:
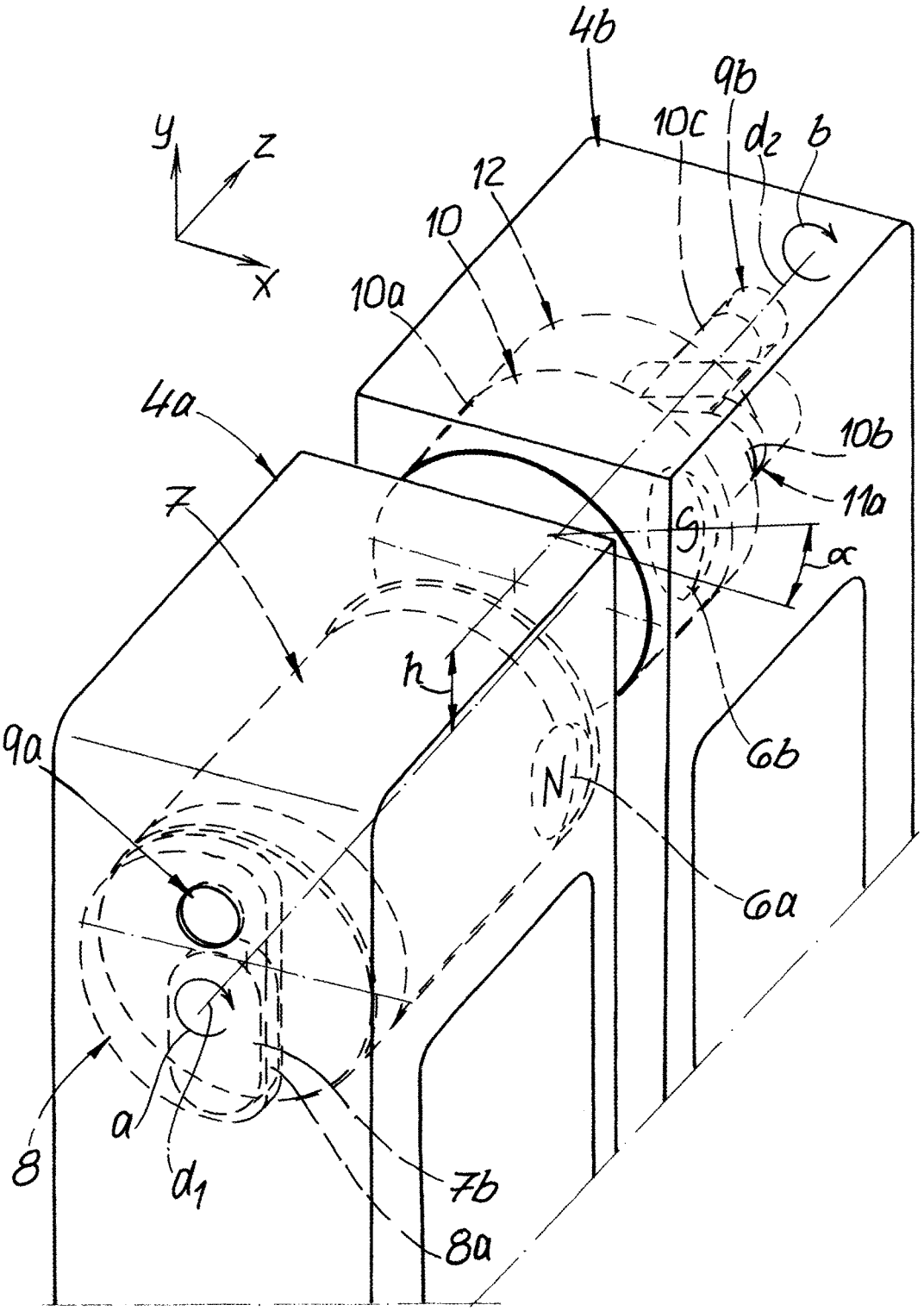
FIGS. 4A-4C are perspective views of details showing intermediate positions during the closing process.
Figure 4B:
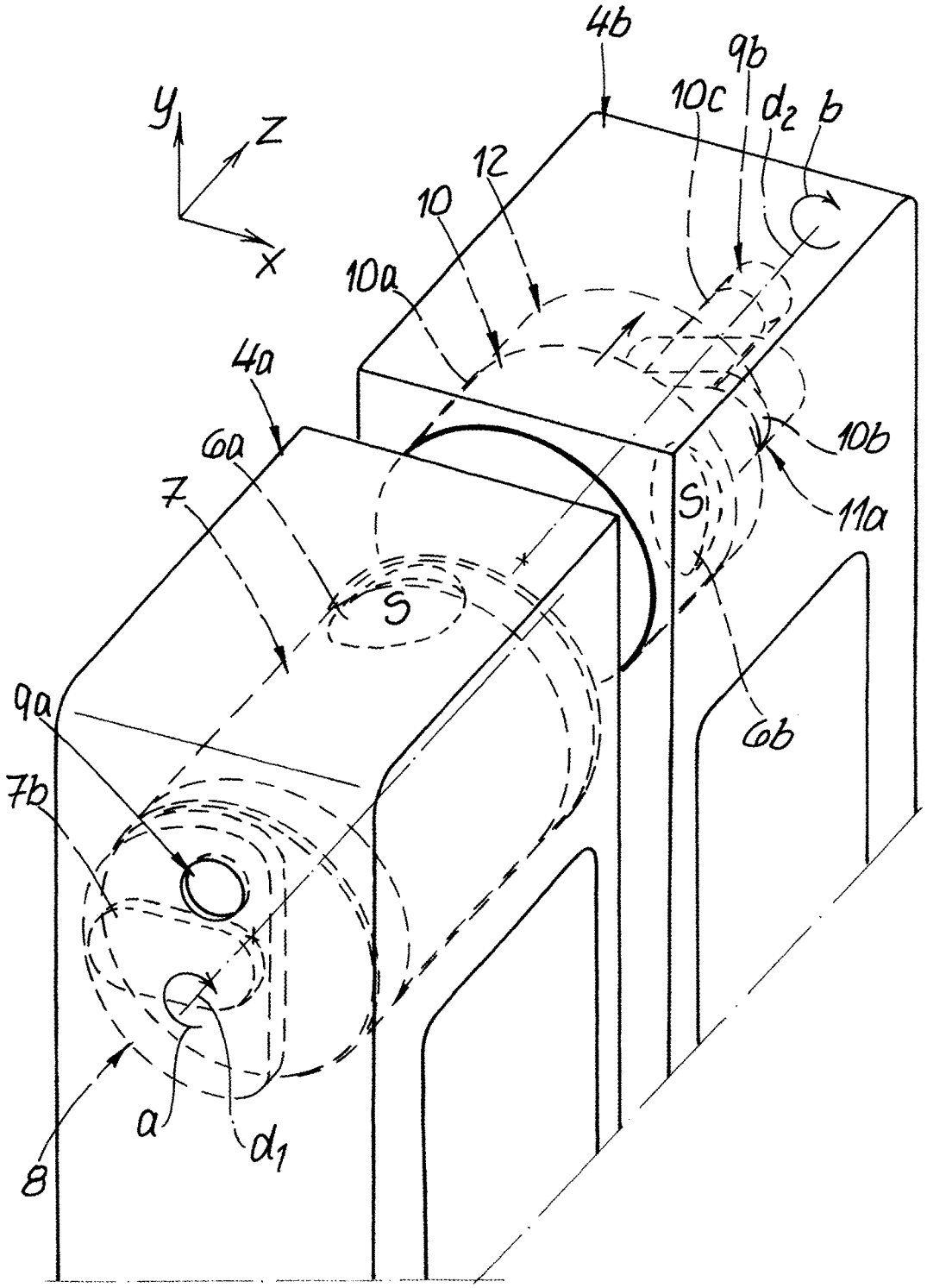
Figure 4C:
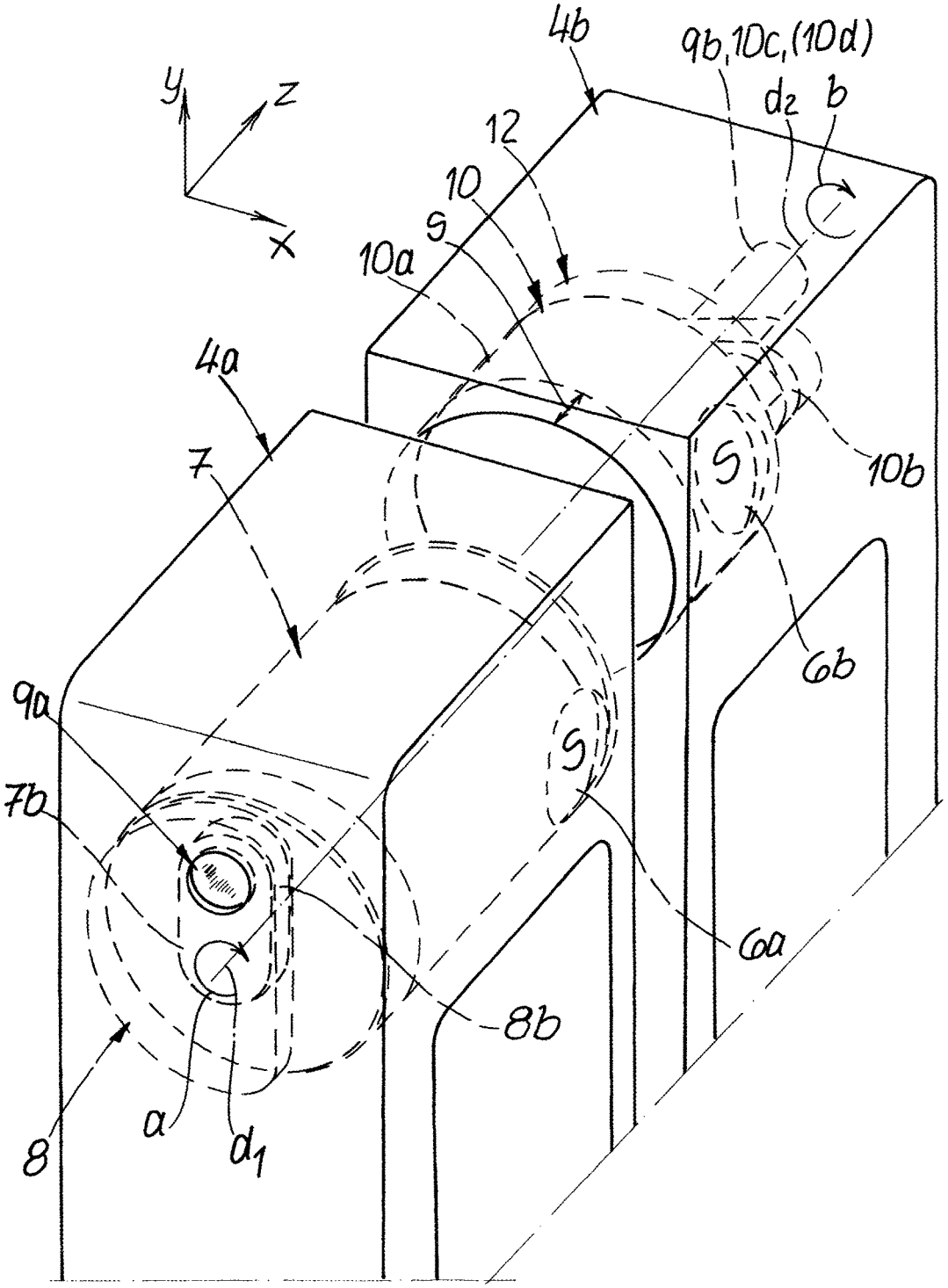

FIGS. 4A to 4C illustrate the functionality of the door-operating assembly according to the invention during transition from the first functional state (opening position) to the second functional state (closing position).

The first functional position is shown in FIG. 4A that corresponds to the open position of a magnetic lock in this embodiment. The first magnet 6*a* is rotatable in the first sleeve 7 about the first axis $d_1$. At the same time, the second magnet 6*b* is supported in the second sleeve 10 on the status-indicator housing 4*b* so as to be rotatable about the second axis $d_2$. The first axis $d_1$ and the second axis $d_2$ run parallel to one another and are spaced in the vertical direction y with a vertical offset h that makes it possible for the first sleeve 7 with a fluted outer surface 7*a* to project into the opening 5 of the operating-device housing 4*a*, whereas the second sleeve 10 with an identical outer diameter is accommodated completely in the housing of the status-indicator housing 4*b*. The housing 4*a* and 4*b* have identical external dimensions.

In the functional state illustrated in FIG. 4A, the magnetic directions of the first magnet 6*a* and second magnet 6*b* are opposite. The magnetic direction of the first magnet 6*a* runs in the horizontal direction x. Meanwhile, the magnetic direction of the second magnet 6*b* is inclined by an angle α of approximately 30° relative to the horizontal direction x (or relative to a horizontal plane). Due to magnetic directions pointing generally oppositely, the two magnets 6*a* and 6*b* attract one another in the axial direction, namely in the thickness direction z. The first sleeve 7 is mounted in the operating-device housing 4*a* so as to be immovable parallel to the first axis $d_1$. Meanwhile, the second sleeve 10 can be displaced in the status-indicator housing 4*b* along the second axis $d_2$ within the positive guides formed by the outer shape of the sleeve 10 and the associated recess 12 of the status-indicator housing 4*b*. Due to the magnetic attraction in the axial direction in the first functional position, the second sleeve 10 is displaced in the axial direction toward the operating-device housing 4*a* and abuts against an outer surface of the door panel 1.

The magnetic attraction between the first magnet 6*a* and the second magnet 6*b* also has the effect that torque is exerted on the first sleeve 7 counter to the rotational sense a and torque is exerted on the second sleeve 10 in the second rotation direction b. In the embodiment, the first rotation direction a and the second rotation direction b are aligned in the same direction. Further rotation beyond the functional state shown is prevented, however, since the first sleeve 7 abuts with the ridge 7*b* against the first stop 8*a* of the recess 8 that is formed in the operating-device housing 4*a*. Furthermore, the second sleeve 10 abuts with its ridge 10*b* against the third ridge 11*a* within the status-indicator housing 4*b*. The functional state shown is thus stable, with both the first sleeve 7 and the second sleeve 10 being held magnetically in their positions.

In FIG. 4B, the first sleeve 7 is rotated by approximately 90° in the first rotation direction a through manual interaction of a user. The magnetic directions of the first magnet 6*a* and the second magnet 6*b* thus are parallel and point in the same direction, so that an axial repulsion acts on the second sleeve 10. As a result, the second sleeve 10 slides with the ridge 10*b* into the third portion III of the recess 12 within the status-indicator housing 4*b* that then receives this third portion III in a loose fit. As a result, rotation of the second sleeve 10 is blocked both in the second rotation direction b and counter to the second rotation direction b.

FIG. 4C shows the second functional state (closed state) of the operating-device housing 4*a*. The first sleeve 7 is rotated by an angle of approximately 180° with respect to the first functional position. The ridge 7*b* of the first sleeve 7 now abuts against a second stop 8*b* of the recess 8. Due to the magnetic repulsion in the thickness direction z, the second sleeve 10 is displaced by a spacing s into the second display position. Furthermore, due to the magnetic repulsion, torque is applied to the first sleeve in the first rotation direction a, and torque acts on the second sleeve 10 counter to the second rotation direction b. Further rotation of the first sleeve 7 is prevented by the second stop 8*b*. Rotation of the second sleeve 10 is impeded by the fit between the ridge 10*b* in the third portion III. The first sleeve 7 of the operating-device housing 4*a* is held in the second functional position by this magnetic repulsion.

A return to the first functional state (FIG. 4A) takes place analogously. Here, the orientation of the first magnet 6*a* relative to the second magnet 6*b* changes again in the course of reverse rotation to an opposite, attractive orientation, whereby the second sleeve 10 is moved back into the first display position.

Figure 5A:
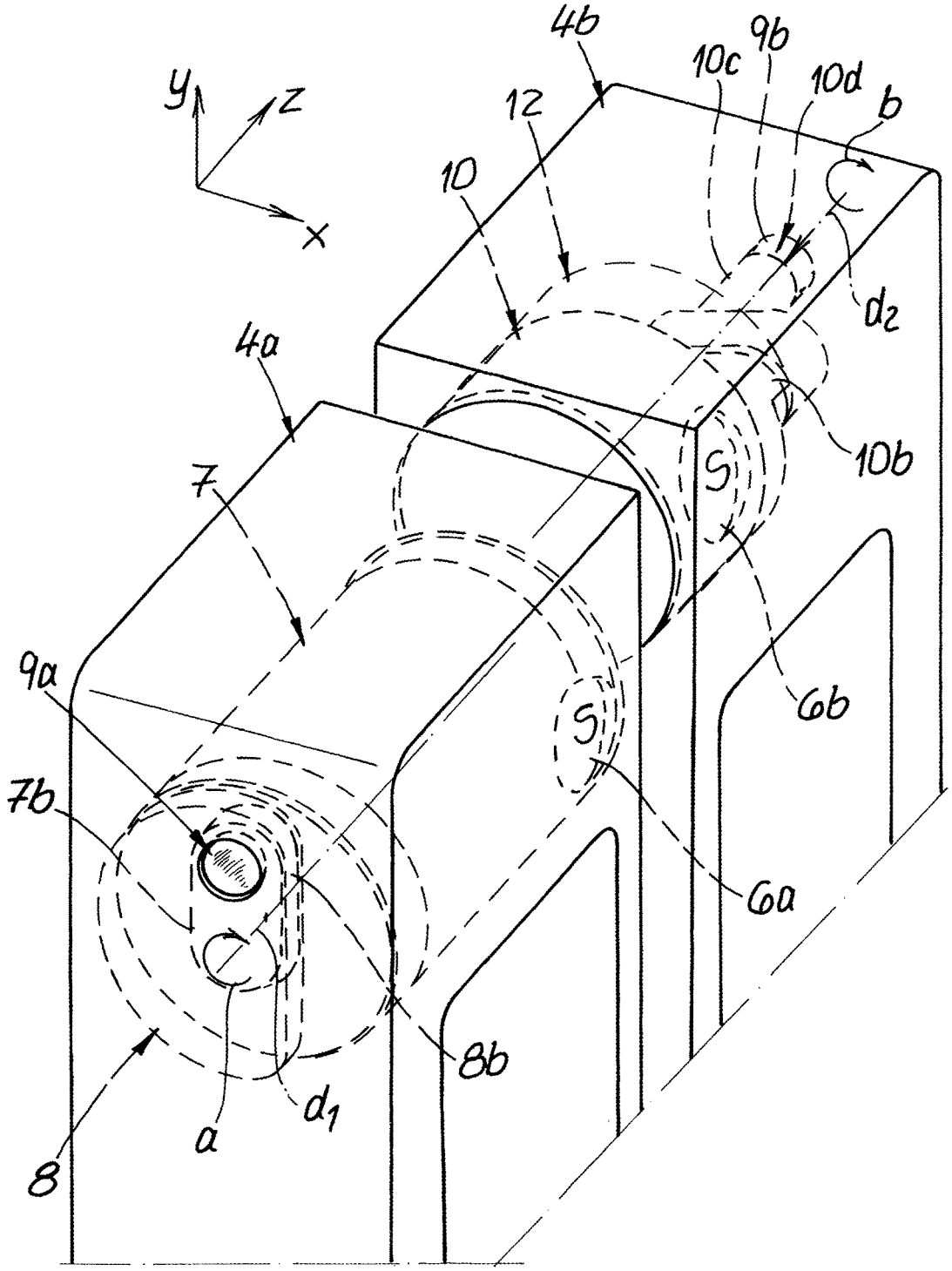
FIGS. 5A and 5B are views of details showing intermediate positions in an emergency release.
Figure 5B:
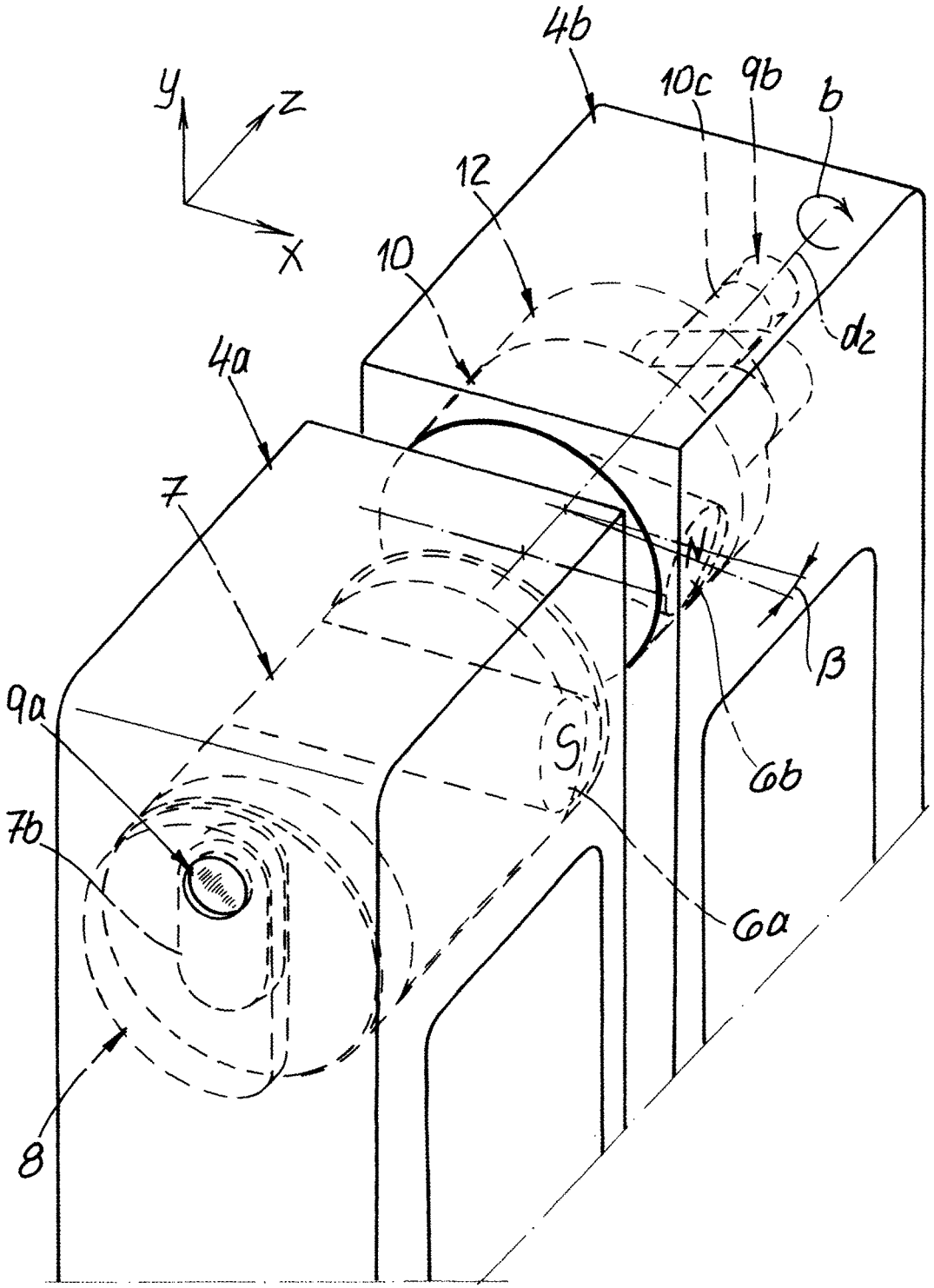

The emergency release function will be explained with reference to FIGS. 5A and 5B. Starting from the closed position shown in FIG. 4C, the second sleeve 10 can be moved into the release position shown in FIG. 5A by application of manual pressure on the end face 10*d* with a pointed object. The mechanical repulsion in the axial direction is overcome by the mechanical pressure on the end face 10*d*. In the release position, the ridge 10*b* of the second sleeve 10 exits the complementary receptacle of the third portion III, so that the second sleeve 10 can rotate counter to the second rotation direction b due to the magnetic torque. This enables the second sleeve 10 to rotate into the emergency release position shown in FIG. 5B. In that position, the first magnet 6*a* and the second magnet 6*b* are parallel and point oppositely, thereby unlocking the magnetic latch.

Figure 6A:
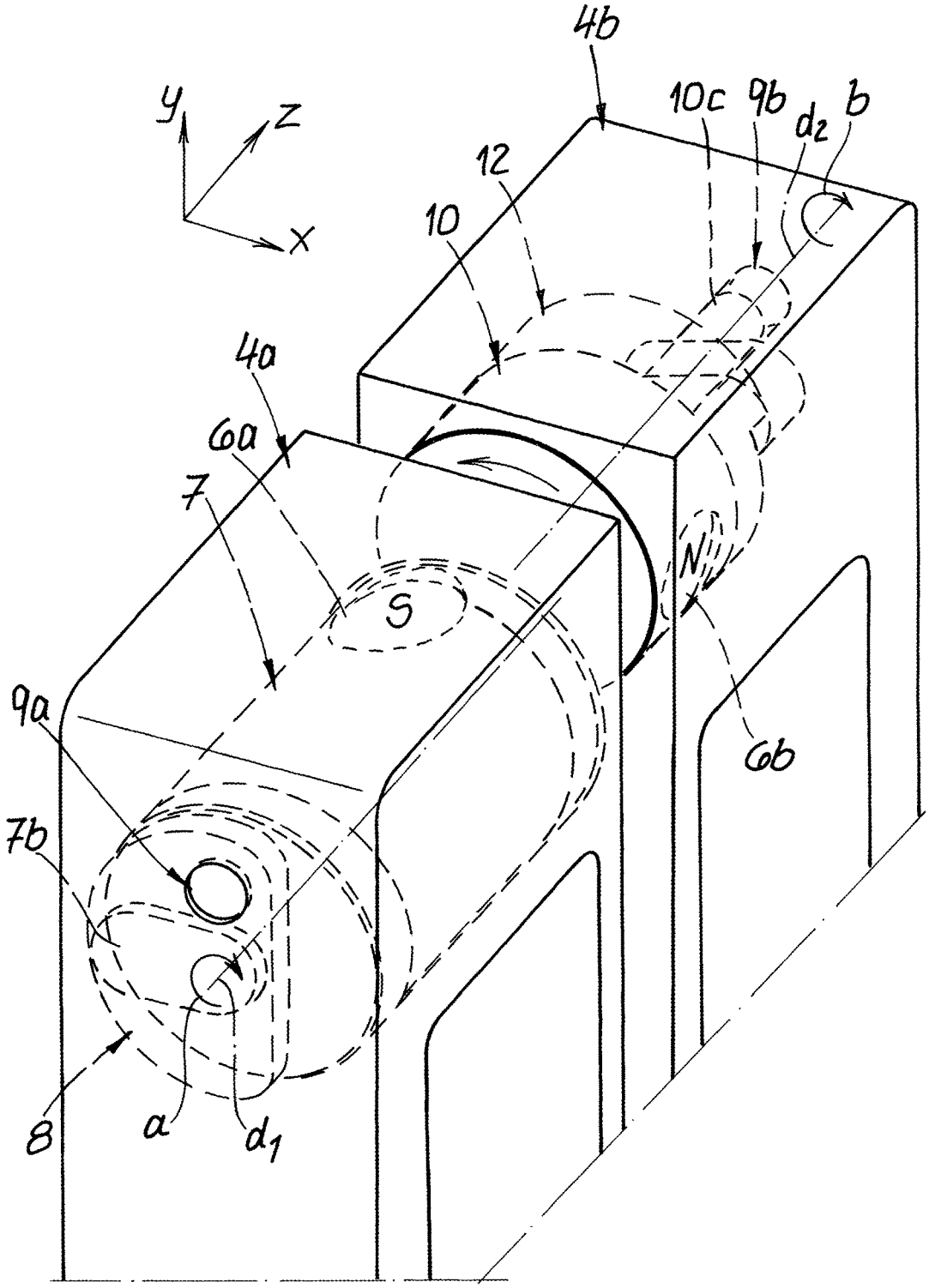
FIGS. 6A and 6B are views of details showing intermediate positions during a return to position after an emergency release.
Figure 6B:
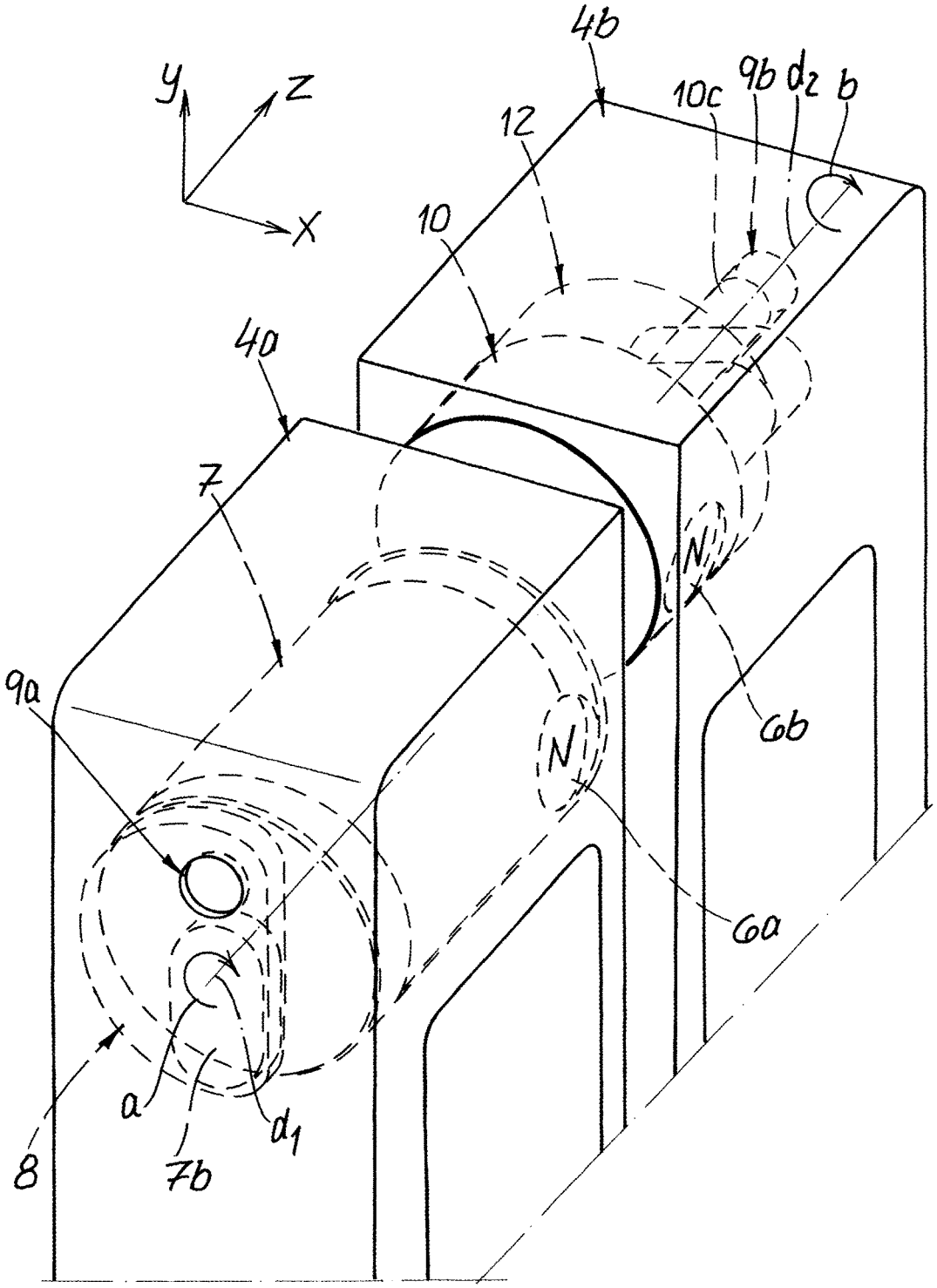

The door-operating assembly returns to its position (as shown in FIGS. 6A and 6B) the next time the first sleeve 7 is returned to the first functional state. In the emergency release position (FIG. 5B), the second sleeve 10 is rotated such that the second magnet 6*b* is oriented in an opposite position relative to the first magnet 6*a*. Rotation of the sleeve is limited in such a way that alignment of the second magnet 6*b* relative to the horizontal (horizontal direction x) forms an angle α. Further rotation counter to the second rotation direction b is limited by reaching the fourth stop 11*b* with the ridge 10*b* of the second sleeve 10. During this reverse rotation (FIG. 6*a*), the first magnet 6*a* exerts a torque on the second magnet 6*b* counter to the second rotation direction b that, however, is blocked against further rotation by the fourth stop 11*b*. When the first functional position is reached by the first sleeve 7 (FIG. 6B), the magnetic directions of the first magnet 6*a* and the second magnet 6*b* are again parallel but point oppositely. Here, the orientation of the first magnet 6*a* and the second magnet 6*b* are parallel to one another shortly before reaching the first functional position, when the first magnet 6*a* was also inclined by the angle α relative to the horizontal. When this position is exceeded, the torque ratios are reversed, so that the first magnet exerts a torque on the second magnet 6*b* in the second rotation direction b. As a result, the second sleeve 10 rotates back to the initial state shown in FIG. 3A.

It can also be seen in FIG. 1 that a latch 13 is embedded in the door jamb 3. This comprises a housing 13*a* that is securely connected to the door jamb 3 as well as a holder 13*b* that can be displaced within the housing 13*a*. A bolt 13*c* in which a permanent magnet 13*d* is accommodated is guided on the housing horizontally in the horizontal direction x. Due to the magnetic interaction of the permanent magnet 13*d* with the far magnetic field of the first magnet 6*a* and second magnet 6*b*, a closing function is provided in the embodiment. In this case, the bolt 13*c* can engage in a strike plate 14*a*. In order to avoid interference with the magnetic field, the strike plate 14*a* is preferably nonmagnetic. In the vertical direction y below the strike plate 14*a*, a magnetizable locking plate 14*b* is secured to the door panel 1, which forms an additional magnetic part of the door by locking magnets 13*e* that are accommodated in the holder 13*b*.

Figure 7A:
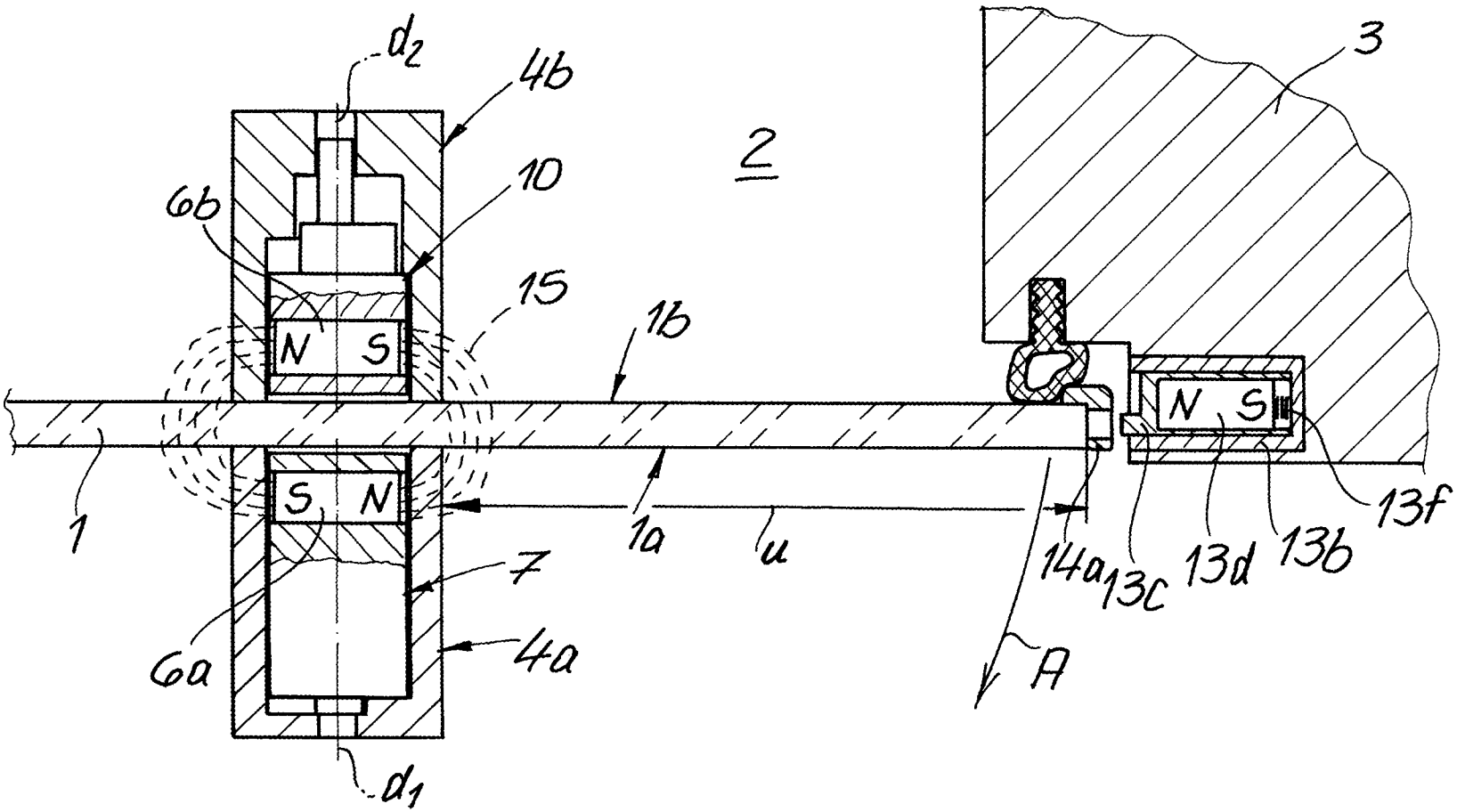
FIGS. 7A-7C are horizontal sections through the structure shown in FIG. 1 in different closed positions of the door assembly.
Figure 7B:
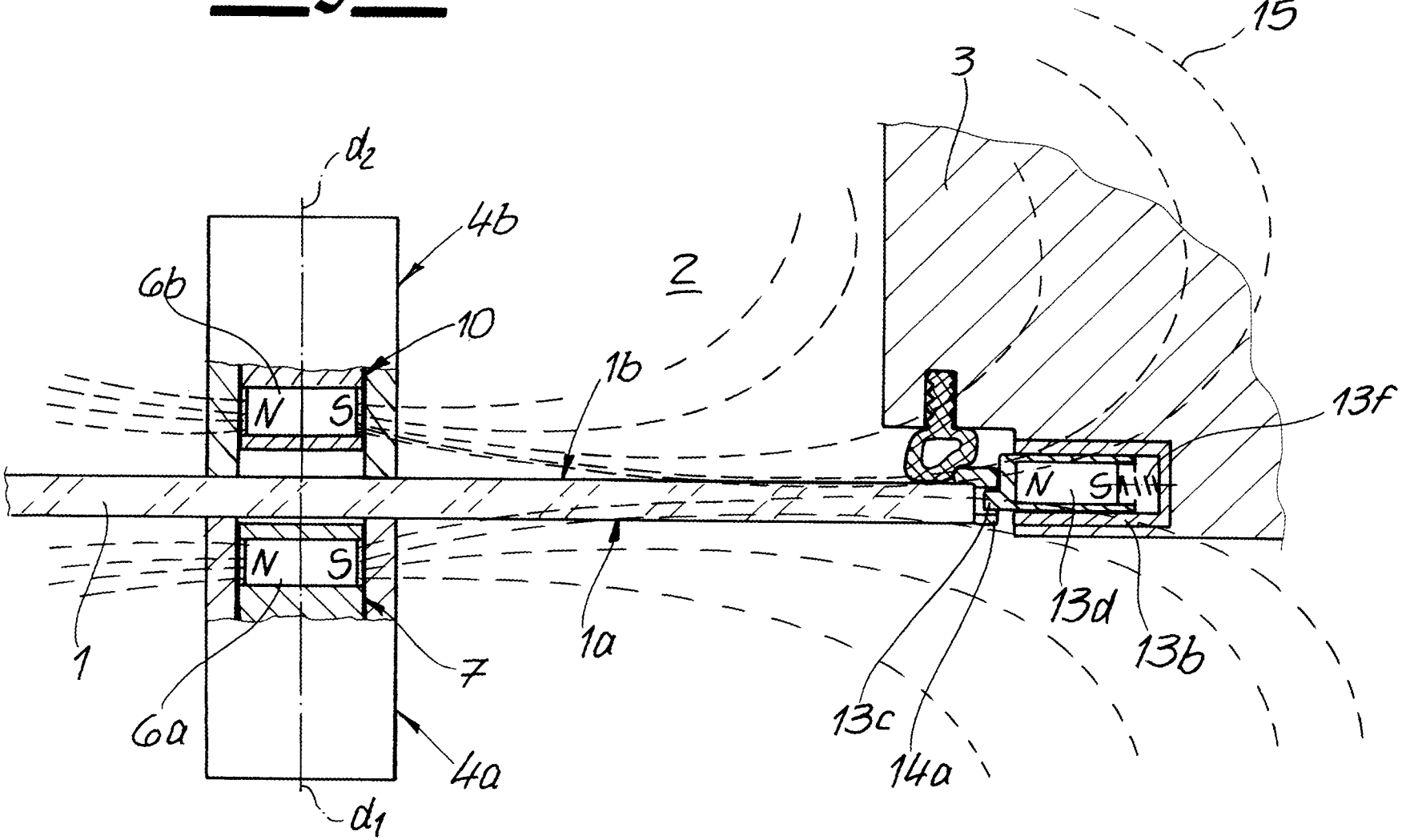
Figure 7C:
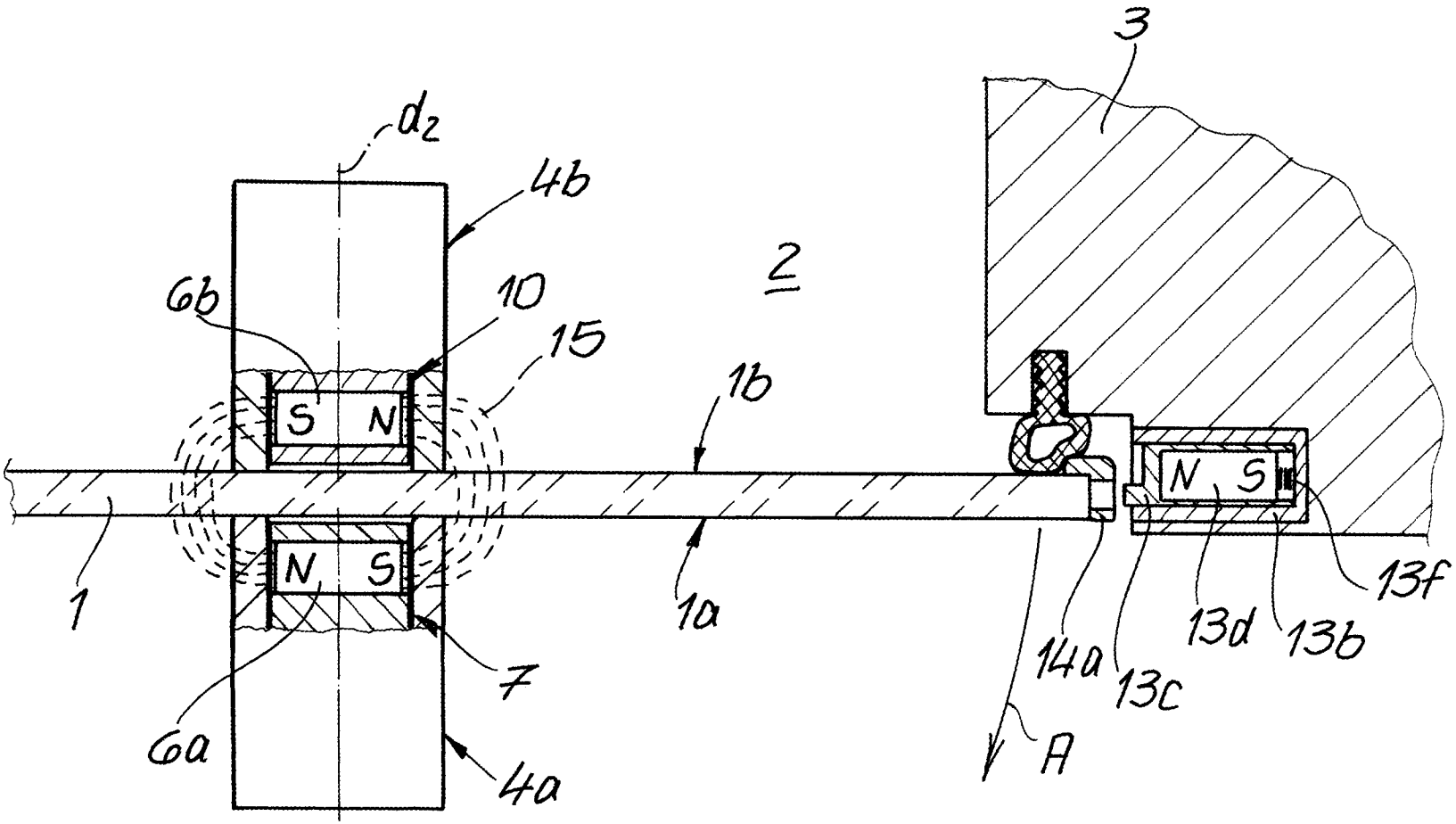

The function of the magnetic lock is clear from FIGS. 7A to 7C. These figures show a simplified section through the door according to the invention at the level of the first magnet 6*a* and of the permanent magnet 13*d*. The operating-device housing 4*a* and the status-indicator housing 4*b* are greatly simplified here and only shown as outlines. A detailed illustration of the sleeves 7, 10 has also been omitted. In the first functional position shown in FIG. 7A (with the first display position of the status-indicator housing 4*b*), the magnetic directions of the first magnet 6*a* and the second magnet 6*b* point oppositely. This "short-circuits" the field lines 15 indicated by broken lines, so that there is no active far field in the area of the bar magnet 13*d*. As a result, the bolt 13*c* is brought into a retracted position within the holder 13*b* by a spring or return element 13*f*. In this release position, there is no interaction between the bolt 13*c* and the strike plate 14*a*, so that the door panel 1 can be moved out of the closed position in the opening direction A.

In the closed position shown in FIG. 7B, the first magnet 6*a* has been pivoted about the first axis $d_1$, so that the magnetic directions of the first magnet 6*a* and the second magnet 6*b* point in the same direction. The two magnetic fields are cumulative, so that the far field of the two magnets 6*a* and 6*b* is effective all the way to the permanent magnet 13*d*. Because of the corresponding alignment, there is an attraction of the magnet 13*d* toward the status indicator 3 and the housings 4*a* and 4*b*. The bolt 13*c* is consequently moved into a locking position, in which it fits with the strike plate 14*a* and thus prevents the door panel 1 from moving in the opening direction A.

FIG. 7C, in turn, shows the emergency release position, in which the magnetic directions of the first magnet 6*a* and the second magnet 6*b* are parallel and point oppositely. The polarity is reversed in each case, since the first magnet 6*a* is in the second functional position and the second magnet 6*b* is in the emergency release position. The field lines are thus "short-circuited," as it were, so that the bolt 13*c* is again in the release position.

We claim:

1. A door-operating assembly comprising:

an operating device having a device housing and a device magnet rotatable in the housing about a first axis between a first functional position and a second functional position; and a status indicator that is coupled with the operating device and has an indicator housing and an indicator magnet movable in the indicator housing along the first axis between a first display position and a second display position, the magnets being so oriented that rotation of the device magnet about the first axis from the respective first functional position into the respective second functional position displaces the indicator magnet axially of the first axis from the first display position into the second display position.

2. The door-operating assembly according to claim 1, wherein the indicator magnet has display element that is not visible on an outer surface of the status indicator in the first display position and is visible on an outer surface of the indicator housing in the second display position.

3. The door-operating assembly according to claim 2, wherein the display element is formed by a pin with an end face that is visible on the outer surface in the second display position.

4. The door-operating assembly according to claim 1, wherein the first magnet is oriented perpendicular to the first axis and the second magnet assembly comprises a second magnet that is also oriented perpendicular to the first axis.

5. The door-operating assembly according to claim 4, wherein, in the first display position a magnetic direction of the first magnet points generally oppositely to a magnetic direction of the indicator magnet generally in the same direction as the second magnet in the second display position.

6. The door-operating assembly according to claim 1 wherein the device housing is formed with a first stop against which the device magnet bears opposite a first direction in a first functional position and is there blocked from further movement opposite the first direction and, angularly offset therefrom about the first axis in the first direction, a second stop against which the device magnet bears in the first direction on movement from the first position in the first direction into a second functional position and is there blocked from further movement in the first direction.

7. The door-operating assembly according to claim 6, wherein in the first position of the device magnet, the device magnet exerts a torque urging the indicator magnet to rotate into the respective second position.

8. The door-operating assembly according to claim 1, further comprising:

a magnetically operable latch fixed adjacent the assembly and operable by a magnetic field of the magnets.

9. The door-operating assembly according to claim 1, wherein the indicator housing is formed with angularly offset third and fourth stops between which the indicator magnet can move angularly in the first display position and against which the indicator magnet bears in the first and second display positions, the display magnet being nonrotatable about the axis in the second display position, the device magnet exerting when in the respective first functional position a torque on the indicator magnet in the respective second display position.

10. In combination with the door-operating assembly according to claim 1:

a door panel having a pair of oppositely horizontally directed faces and an outer edge, the device housing being mounted on one of the faces offset from the outer edge and the indicator housing being mounted on the other of the faces directly opposite the device housing and also offset from the outer edge; and a jamb against which the outer edge is engageable.

11. The combination according to claim 10, wherein the door panel is continuous and imperforate between the housings.

12. The combination according to claim 11, wherein the door panel is wholly of glass.

13. The combination according to claim 11, further comprising:

a magnetic latch on the door jamb operable by the magnets of the assembly.

14. The combination according to claim 13, wherein the latch is only operable by the assembly when magnetic directions of the magnets are generally parallel to each other and directed at or away from the latch, the door panel being continuous and imperforate at least in the area of the operating device and status indicator.

15. The combination according to claim 13, wherein the housings are spaced from the latch in a closed position of the door.

* * * * *